US011410667B2

(12) United States Patent
Chakravarty et al.

(10) Patent No.: US 11,410,667 B2
(45) Date of Patent: Aug. 9, 2022

(54) HIERARCHICAL ENCODER FOR SPEECH CONVERSION SYSTEM

(71) Applicant: Ford Global Technologies, LLC, Dearborn, MI (US)

(72) Inventors: Punarjay Chakravarty, Campbell, CA (US); Lisa Scaria, Milpitas, CA (US); Ryan Burke, Palto Alto, CA (US); Francois Charette, Tracy, CA (US); Praveen Narayanan, San Jose, CA (US)

(73) Assignee: Ford Global Technologies, LLC, Dearborn, MI (US)

( * ) Notice: Subject to any disclaimer, the term of this patent is extended or adjusted under 35 U.S.C. 154(b) by 387 days.

(21) Appl. No.: 16/457,150

(22) Filed: Jun. 28, 2019

(65) Prior Publication Data

US 2020/0411018 A1 Dec. 31, 2020

(51) Int. Cl.

*G10L 19/02* (2013.01)
*G10L 19/00* (2013.01)
*G10L 19/16* (2013.01)

(52) U.S. Cl.

CPC ..... *G10L 19/02* (2013.01); *G10L 19/00* (2013.01); *G10L 19/0018* (2013.01); *G10L 19/167* (2013.01)

(58) Field of Classification Search

CPC ..... G10L 19/02; G10L 19/00; G10L 19/0018; G10L 19/167; G10L 13/10; G10L 13/047; G10L 15/16

See application file for complete search history.

(56) References Cited

U.S. PATENT DOCUMENTS

| | | | | |
|---|---|---|---|---|
| 5,704,006 | A | 12/1997 | Iwahashi | |
| 8,615,388 | B2 | 12/2013 | Li et al. | |
| 8,930,183 | B2 | 1/2015 | Chun et al. | |
| 9,613,620 | B2 | 4/2017 | Agiomyrgiannakis et al. | |
| 10,186,251 | B1 | 1/2019 | Mohammadi | |
| 10,741,169 | B1 * | 8/2020 | Trueba | G10L 13/10 |
| 2008/0306727 | A1 | 12/2008 | Thurmair et al. | |
| 2018/0129938 | A1 * | 5/2018 | Xiong | G06N 3/0445 |
| 2018/0261214 | A1 * | 9/2018 | Gehring | G06F 40/47 |
| 2018/0342256 | A1 | 11/2018 | Huffman et al. | |

(Continued)

OTHER PUBLICATIONS

Bahdanau et al., "Neural Machine Translation by Jointly Learning to Align and Translate", ICLR, 2015.*

(Continued)

*Primary Examiner* — Anne L Thomas-Homescu

(74) *Attorney, Agent, or Firm* — Brandon Hicks; Bejin Bieneman PLC

(57) ABSTRACT

A speech conversion system is described that includes a hierarchical encoder and a decoder. The system may comprise a processor and memory storing instructions executable by the processor. The instructions may comprise to: using a second recurrent neural network (RNN) (GRU1) and a first set of encoder vectors derived from a spectrogram as input to the second RNN, determine a second concatenated sequence; determine a second set of encoder vectors by doubling a stack height and halving a length of the second concatenated sequence; using the second set of encoder vectors, determine a third set of encoder vectors; and decode the third set of encoder vectors using an attention block.

20 Claims, 5 Drawing Sheets

(56) References Cited

U.S. PATENT DOCUMENTS

| | | | | |
|---|---|---|---|---|
| 2019/0122145 | A1* | 4/2019 | Sun | G06F 40/295 |
| 2019/0251952 | A1 | 8/2019 | Arik et al. | |
| 2020/0012953 | A1* | 1/2020 | Sun | G06K 9/6215 |
| 2020/0043467 | A1* | 2/2020 | Qian | G10L 21/0308 |
| 2020/0074637 | A1* | 3/2020 | Wong | G06T 7/11 |
| 2020/0082928 | A1* | 3/2020 | Wu | G16H 80/00 |
| 2020/0126538 | A1* | 4/2020 | Han | G10L 15/063 |
| 2020/0250794 | A1* | 8/2020 | Zimmer | G06T 3/4076 |
| 2020/0258496 | A1* | 8/2020 | Yang | G10L 13/07 |
| 2020/0312346 | A1* | 10/2020 | Fazeli | G06N 3/08 |
| 2020/0320116 | A1* | 10/2020 | Wu | G06F 16/739 |
| 2020/0327884 | A1* | 10/2020 | Bui | G10L 15/16 |
| 2021/0279551 | A1* | 9/2021 | Hashimoto | G06N 3/084 |

OTHER PUBLICATIONS

Lee et al., "Fully Character-Level Neural Machine Translation without Explicit Segmentation", arXiv, Jun. 13, 2017.*

Zhang et al., "Sequence-to-Sequence Acoustic Modeling for Voice Conversion", Preprint Manuscript of IEEE/ACM Transactions on Audio, Speech and Language Processing @2018 IEEE. (Year: 2018).*

Ghosh et al., "Representation Learning for Speech Emotion Recognition", INTERSPEECH 2016, Sep. 8-12, 3016, San Francisco, USA. (Year: 2016).*

Ju-chieh Chou, et. al., "One-Shot Voice Conversion by Separating Speaker and Content Representations with Instance Normalization", College of Electrical Engineering and Computer Science, National Taiwan University, retrieved from Internet URL: https://arxiv.org/abs/1904.05742 (5 pages).

Jing-Xuan Zhang, et. al., "Sequence-to-Sequence Acoustic Modeling for Voice Conversion", IEEE/ACM Transactions on Audio, Speech and Lanugage Processing, retrieved from Internet URL: https://arxiv.org/abs/1810.06865(13 pages).

Hossein Zeinali, et. al., "Convolutional Neural Networks and X-Vector Embedding for DCASE2018 Acoustic Scene Classification Challenge", Detection and Classification of Acoustic Scenes and Events 2019, Nov. 19-20, 2018, Surrey, United Kingdom, retrieved from Internet URL: https://arxiv.org/abs/1810.04273 (5 pages).

Gokce Keskin, et. al., "Many-to-Many Voice Conversion with Out-of-Dataset Speaker Support", Intel AI Lab, Santa Clara, California, Apr. 30, 2019 retrieved from Internet URL: https://arxiv.org/abs/1905.02525 (5 pages).

Takuhiro Kaneko, et. al., "Parallel-Data-Free Voice Conversion Using Cycle-Consistent Adversarial Networks", NTT Communication Science Laboratories, NTT Corporation, Japan, Dec. 20, 2017, retrieved from Internet URL: https://arxiv.org/abs/1711.11293 (5 pages).

Jon Magnus Momrak Haug, "Voice Conversion Using Deep Learning", Jul. 2019, Norwegian University of Science and Technology, Department of Electronic Systems, retrieved from Internet URL: https://pdfs.semanticscholar.org/8a25/70500576e3b86a68ef443847f9b8f05f9176.pdf (51 pages).

Jan Chorowski, et. al., "Attention-Based Models for Speech Recognition", retrieved from arXiv:1506.07503v1 [cs.CL] Jun. 24, 2015 (19 pages).

Yuxuan Wang, e. al., "Tacotron: Towards End-to-End Speech Synthesis", retrieved from arXiv:1703.10135v2 [cs.CL] Apr. 6, 2017 (10 pages).

William Chan, et. al., "Listen, Attend and Spell", retrieved from arXiv:1508.01211 v2 [cs.CL] Aug. 20, 2015 (16 pages).

Melvin Johnson, et. al., "Google's Multilingual Neural Machine Translation System: Enabling Zero-Shot Translation", retrieved from arXiv:1611.04558v2 [cs.CL] Aug. 21, 2017 (17 pages).

Jonathan Shen, et. al., "Natural TTS Synthesis by Conditioning Wavenet on Mel Spectrogram Predictions", rerieved from arXiv:1712.05884v2 [cs.CL] Feb. 16, 2018 (5 pages).

* cited by examiner

500

HIERARCHICAL ENCODER FOR SPEECH CONVERSION SYSTEM

BACKGROUND

An Automatic Speech Recognition (ASR) engine may receive audio as input and may classify the audio into text. And a Text-To-Speech (TTS) engine may receive the text and output speech representation. However, such a process using ASR and TTS engines suffers a loss of temporality.

DETAILED DESCRIPTION

Figure 1:
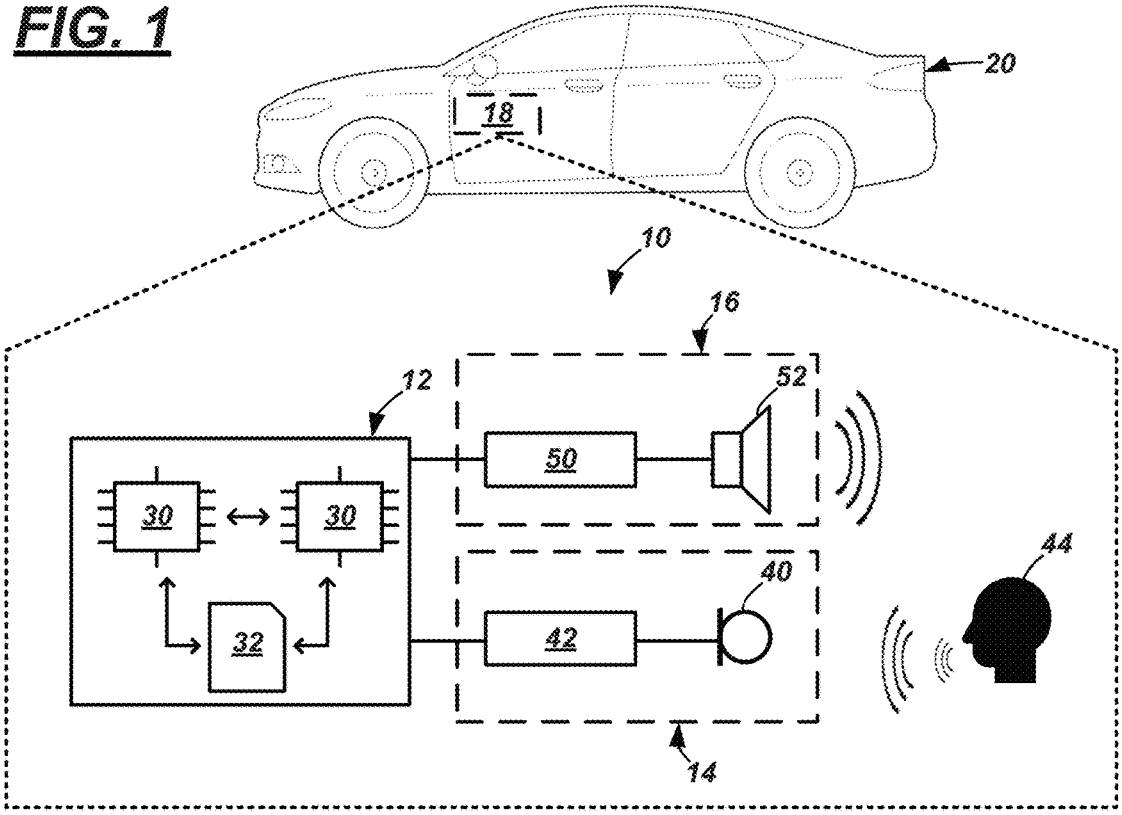
FIG. 1 is a schematic diagram illustrating a speech conversion system that may be implemented in a vehicle.

A speech conversion system is described that includes a hierarchical encoder and a decoder. The system may comprise a processor and memory storing instructions executable by the processor. The instructions may comprise to: using a second recurrent neural network (RNN) (GRU1) and a first set of encoder vectors derived from a spectrogram as input to the second RNN, determine a second concatenated sequence; determine a second set of encoder vectors by doubling a stack height and halving a length of the second concatenated sequence; using the second set of encoder vectors, determine a third set of encoder vectors; and decode the third set of encoder vectors using an attention block.

According to the at least one example set forth above, the instructions further comprise to, prior to determining the second concatenated sequence: using a first RNN (GRU0) and a plurality of preprocessed encoder vectors as input to the first RNN, determine a first concatenated sequence; and determine the first set of encoder vectors by doubling a stack height and halving a length of the first concatenated sequence.

According to the at least one example set forth above, the first and second RNNs are gated recurrent unit (GRUs) and each are bidirectional pass.

According to the at least one example set forth above, the processor further uses a third RNN, wherein the third RNN receives, as input, the second set of encoder vectors and provides, as output, the third set of encoder vectors.

According to the at least one example set forth above, the third RNN is a gated recurrent unit (GRU) and is bidirectional pass.

According to the at least one example set forth above, the spectrogram is a mel-spectrogram.

According to the at least one example set forth above, the spectrogram comprises a plurality of concatenated vectors, wherein the spectrogram is a visual representation of a speech utterance.

According to the at least one example set forth above, the instructions further comprise to, prior to determining the second set of encoded vectors: based on the input and using an encoder preprocessing neural network (PRENET) and a convolutional filter-banks and highways (CFBH) layer, determine a plurality of preprocessed encoder vectors; and using a first RNN (GRU0) and the plurality of preprocessed encoder vectors as input to the first RNN, determine the first set of encoder vectors.

According to the at least one example set forth above, the instructions further comprise to: at the attention block, iteratively generate an attention context vector; and provide the attention context vector.

According to the at least one example set forth above, the instructions further comprise to: determine a best match vector from among the third set of encoder vectors by comparing the third set of encoder vectors to a previous-best match vector; and provide the attention block with the best match vector in order to determine an updated attention context vector.

According to the at least one example set forth above, the instructions further comprise to: at the attention block: receive as input one of the third set of encoded vectors; at the attention block: receive as input at least one of a set of decoder hidden vectors; at the attention block: determine an attention context vector; and provide the attention context vector.

According to the at least one example set forth above, the third set of encoded vectors are a set of hidden encoder vectors.

According to the at least one example set forth above, the instruction to decode further comprises to: determine a set of hidden decoder vectors by receiving as input, at an attention recurrent neural network (RNN), a first set of decoder vectors, wherein at least one of the first set of decoder vectors comprises a concatenation of the attention context vector and at least one of a plurality of preprocessed decoder vectors; using a residual decoder stack and the set of hidden decoder vectors, determine a set of decoder output vectors; feedback at least one of the set of decoder output vectors as input to a decoder preprocessing neural network (PRENET); and use the decoder PRENET to determine and update the plurality of preprocessed decoder vectors.

According to the at least one example set forth above, the instruction to decode further comprises to: in response to receiving an updated attention context vector, provide an updated at least one of the set of decoder output vectors to the decoder PRENET.

According to another illustrative example, a method of speech conversion is disclosed, comprising: using a second recurrent neural network (RNN) (GRU1) and a first set of encoder vectors derived from a spectrogram as input to the second RNN, determining a second concatenated sequence; determining a second set of encoder vectors by doubling a stack height and halving a length of the second concatenated sequence; using the second set of encoder vectors, determining a third set of encoder vectors; and decoding the third set of encoder vectors using an attention block.

According to the at least one example set forth above, further comprising, prior to determining the second concatenated sequence: using a first RNN (GRU0) and a plurality of preprocessed encoder vectors as input to the first RNN, determining a first concatenated sequence; and determining the first set of encoder vectors by doubling a stack height and halving a length of the first concatenated sequence.

According to the at least one example set forth above, further comprising, prior to determining the second set of encoded vectors: based on the input and using an encoder preprocessing neural network (PRENET) and a convolutional filter-banks and highways (CFBH) layer, determining a plurality of preprocessed encoder vectors; and using a first RNN (GRU0) and the plurality of preprocessed encoder vectors as input to the first RNN, determining the first set of encoder vectors.

According to the at least one example set forth above, further comprising, at the attention block, iteratively generating an attention context vector; and providing the attention context vector.

According to the at least one example set forth above, further comprising, determining a best match vector from among the third set of encoder vectors by comparing the third set of encoder vectors to a previous-best match vector; and providing the attention block with the best match vector in order to determine an updated attention context vector.

According to the at least one example set forth above, further comprising: at the attention block: receiving as input one of the third set of encoded vectors; at the attention block: receiving as input at least one of a set of decoder hidden vectors; at the attention block: determining an attention context vector; and providing the attention context vector.

According to the at least one example, a computer is disclosed that is programmed to execute any combination of the examples set forth above.

According to the at least one example, a computer is disclosed that is programmed to execute any combination of the examples of the method(s) set forth above.

According to the at least one example, a computer program product is disclosed that includes a computer readable medium storing instructions executable by a computer processor, wherein the instructions include any combination of the instruction examples set forth above.

According to the at least one example, a computer program product is disclosed that includes a computer readable medium that stores instructions executable by a computer processor, wherein the instructions include any combination of the examples of the method(s) set forth above.

Turning now to the figures, wherein like reference numerals indicate similar or like features or functions, a computer-implemented sequence-to-sequence (seq2seq) speech conversion system 10 is described—e.g., to convert a first speech audio (e.g., uttered by a first person (e.g., source speaker)) to a second speech audio (e.g., so that the second speech audio appears to be guttered by a second, different person (e.g., target speaker)). To accomplish seq2seq speech conversion, system 10 utilizes a hierarchical encoder that employs multiple neural networks, and which accepts a mel-spectrogram as input. System 10 employs a speech conversion technique that is useful when the speech comprises an element of temporality or has so-called temporal dependencies.

System 10 may perform either a parallel speech conversion or a non-parallel speech conversion. As used herein, parallel speech conversion means both the source and target speakers utter the same speech; thus, as used herein, non-parallel speech conversion means the source and target speakers utter different speech. In the context of the present disclosure, speech is not limited to live utterances; e.g., utterances may be pre-recorded or live; however, speech means words uttered by a human.

FIG. 1 illustrates an example of the speech conversion system 10 that comprises a computer 12, an audio-input system 14, and an audio-output system 16. The illustration shows that this may comprise part of an infotainment system 18 for a vehicle 20 (e.g., such as for Ford™ Sync™ or other such suitable vehicle infotainment/entertainment systems); however, this is merely one example. Other implementations and uses also exist. Vehicle 20 may be any suitable vehicle comprising system 10—e.g., a passenger vehicle, a truck, a sports utility vehicle (SUV), a recreational vehicle, a bus, an aircraft, a marine vessel, or the like. In at least one example, an automotive vehicle is contemplated.

Computer 12 may be any suitable computing device, circuit card, embedded module or the like, server, desktop station, laptop computer, etc. that is configured in hardware and software to perform the speech conversion process(es) described herein. According to an example, computer 12 comprises one or more processors 30 (two are shown only by way of example) and memory 32. Processor(s) 30 may be any type of device capable of processing electronic instructions, non-limiting examples including a microprocessor, a microcontroller or controller, an application specific integrated circuit (ASIC), etc.—just to name a few. In at least one example, processor(s) 30 comprise a graphics processing unit (GPU), a tensor processing unit (TPU), or a combination thereof—thereby providing efficient architectures for parallel processing and operating at a level of batches. In general, processor(s) 30 may be programmed to execute digitally-stored instructions, which may be stored in memory 32, which enable the computer 12 to encode and/or decode human speech. Non-limiting examples of instructions will be described in the one or more processes described below, wherein the order of the instructions set forth below is merely an example.

Memory 32 may include any non-transitory computer usable or readable medium, which may include one or more storage devices or articles. Exemplary non-transitory computer usable storage devices include conventional hard disk, solid-state memory, random access memory (RAM), read-only memory (ROM), erasable programmable read-only memory (EPROM), electrically erasable programmable read-only memory (EEPROM), as well as any other volatile or non-volatile media. Non-volatile media include, for example, optical or magnetic disks and other persistent memory, and volatile media, for example, also may include dynamic random-access memory (DRAM). These storage devices are non-limiting examples; e.g., other forms of computer-readable media exist and include magnetic media, compact disc ROM (CD-ROMs), digital video disc (DVDs), other optical media, any suitable memory chip or cartridge, or any other medium from which a computer can read. As discussed above, memory 32 may store one or more computer program products which may be embodied as software, firmware, or other programming instructions executable by the processor(s) 30. In addition, memory 32 may store the data associated with an operation of system 10, as described more below.

Audio-input system 14 comprises hardware and may comprise at least one microphone 40 and a pre-processing unit 42. Microphone 40 may comprise any suitable transducer that converts sound into an electrical signal. Microphone 40 may comprise any suitable construction (piezoelectric microphones, fiber optic microphones, laser microphones, micro-electrical-mechanical system (MEMS) microphones, etc.) and may have any suitable directionality (omnidirectional, bidirectional, etc.). FIG. 1 illustrates a human/person 44 uttering speech into microphone 40.

Pre-processing unit 42 comprises electronic hardware that may comprise an analog-digital converter (ADC), a digital or analog signal processor (DSP or ASP), one or more amplifiers, one or more audio mixers, and/or the like. It also may comprise any suitable software (e.g., Matlab™) for converting an audio signal into a spectrogram. Pre-processing unit 42 may receive an electrical signal transduced by microphone 40, convert the signal into an audio spectrogram (e.g., a mel-spectrogram), and provide the audio spectrogram to computer 12.

An audio spectrogram is a visual representation of the respective powers associated with a spectrum of frequencies of an audio signal as the respective frequencies vary with time. A mel-spectrogram in the context of the present disclosure is a type of audio spectrogram providing a power spectral density across a spectrum of frequencies according to a mel-frequency scale defined by Equation (1) below. Processor(s) 30 may generate a mel-spectrogram using triangular filters using known techniques.

$$mel = 2595 * \log_{10}\left(1 + \frac{f}{700}\right), \quad \text{Equation (1)}$$

where $f$ is frequency in Hertz (Hz).

Figure 2:
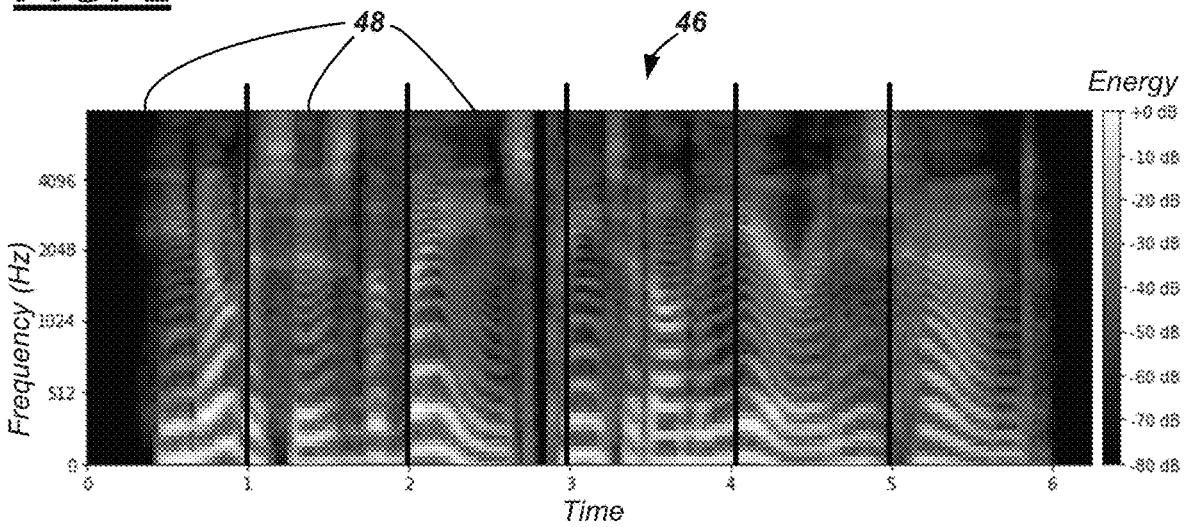
FIG. 2 is a diagram of an example mel-spectrogram that may be an input to the system shown in FIG. 1.

An example of a mel-spectrogram 46 in shown in FIG. 2; here, the mel-spectrogram comprises a set of concatenated mel-vectors 48 (also sometimes called a concatenation of mel-frames or mel-columns). In FIG. 2, frequency (Hz) is plotted against time, wherein different brightnesses and/or colors indicate different energy magnitudes (in decibels).

Returning to FIG. 1, audio-output system 16 comprises hardware that may comprise a post-processing unit 50 and at least one loudspeaker 52. Post-processing unit 50 is electronic hardware that may comprise a digital signal processor (DSP), a digital-analog converter (DAC), one or more amplifiers, one or more audio mixers, and/or the like. Unit 50 also may comprise any suitable software (e.g., Matlab™) for converting computer data back into an audio signal. According to one example, post-processing unit 50 receives a set of decoder output vectors and passes the set of decoder output vectors through a wavenet (e.g., a deep neural network for generating raw audio); thereafter, the signal may be passed through a DSP, a DAC, and/or one or more amplifiers before being received by loudspeaker 52.

Loudspeaker 52 may comprise any suitable electroacoustic transducer that converts an electrical signal into sound. Loudspeaker 52 may comprise a crossover and operate in any suitable frequency range (tweeter, mid-range, woofer, or a combination thereof). FIG. 1 illustrates loudspeaker 52 emitting converted speech—which may or may not be audible by person 44. As will be apparent from the description below, in at least one example, person 44 may utter speech which undergoes speech conversion at computer 12, this speech conversion may be stored (e.g., in memory 32, and at a later time, computer 12 may provide this audio (as a different 'voice') via loudspeaker 52.

Figure 3:
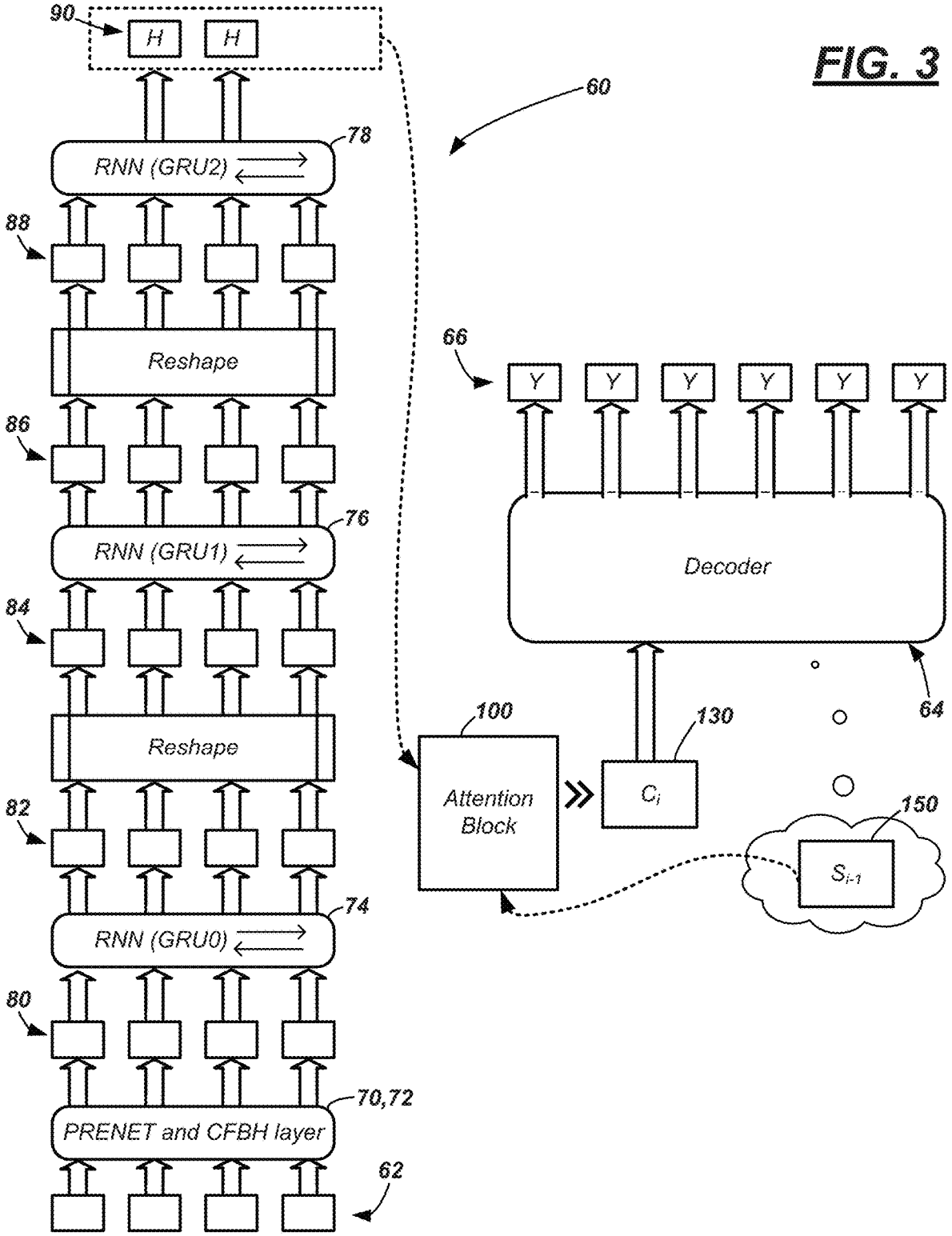
FIGS. 3-4 are schematic views of a hierarchical encoder and a decoder of the system shown in FIG. 1.
Figure 4:
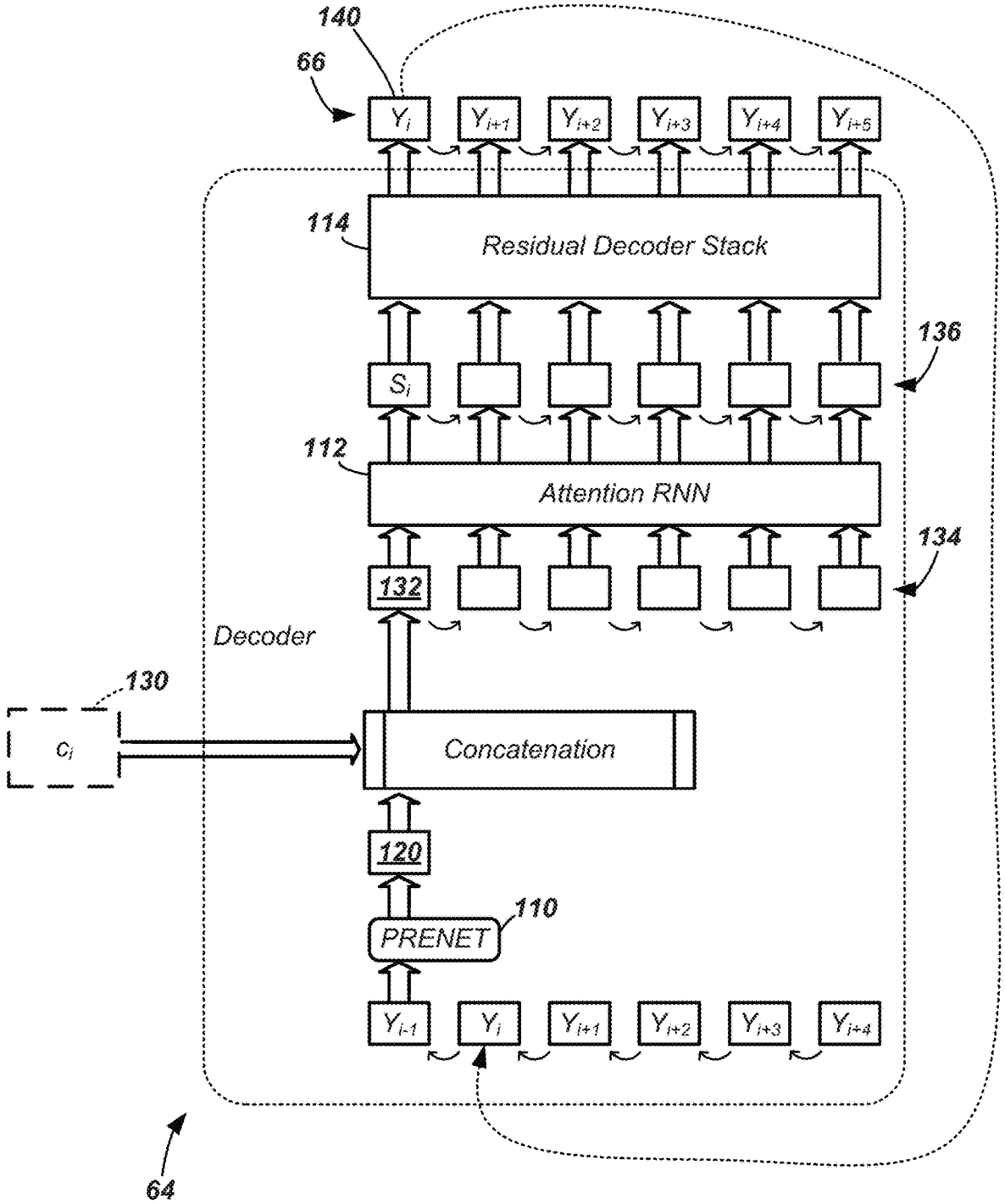

FIGS. 3-4 schematically illustrate a hierarchical encoder 60 that may receive as input an audio spectrogram 62 (representing speech to be converted) and a decoder 64 that provides as output a set of decoder output vectors 66 (which ultimately may be converted to an audio signal). According to an example, the encoder 60 comprises an encoder pre-processing neural network (PRENET) 70 and a convolutional filter-banks and highways (CFBH) layer 72, a first recurrent neural network (RNN) 74, a second RNN 76, and a third RNN 78. Each will be discussed in turn below.

As the name suggests, encoder PRENET 70 is a neural network that receives the audio spectrogram 62 (e.g., the result of Short-Term Fourier Transform (STFT)) and executes pre-preprocessing. In general, encoder PRENET 70 comprises a linear (full) connections, together with a non-linearity and dropout. The process executed by encoder PRENET 70 may serve as a 'bottleneck,' wherein only important features are captured, thereby allowing the network to generalize better to input that the network has not been trained (e.g. new voices for conversion). The 'bottleneck' can be viewed from a standpoint of preventing overfitting (see dropout below). In the present context, 'connections' refer to linear (full) connections (y=Wx+b), on top of which is added a non-linearity (ReLU). In the present context, a 'dropout' refers to a mechanism to prevent overfitting in neural networks. This may be accomplished by randomly 'dropping' or zeroing out some fraction of units or 'nodes' in the neural network (e.g., the fraction of units may be 0.5). This introduces some noise in the computations which have the effect of learning relevant features and preventing overfitting As described more below, the spectrogram 62 received by the encoder PRENET 70 may be a mel-spectrogram (or a plurality of concatenated mel-vectors). Generally, such a plurality of vectors can be referred to as a sequence. Thus, as used herein, a sequence (either input sequence or output sequence) refers to a plurality of concatenated vectors. And generally, vectors may be referred to as columns or frames as well, in the context of the current disclosure. In the context of the present disclosure, a sequence has at least two dimensions: a stack height (Z) (units) and a length (T). And a sequence's dimensionality may be expressed as Z×T. In practice, inputs may be aggregated in mini-batches for parallel processing in a GPU (e.g., if a dimensionality is Z×T, vectors may be grouped into batches of B, so that the aggregated input (a "tensor") operates at the level of B×Z×T).

While shown in the same block, CFBH layer 72 may follow encoder PRENET 70 (e.g., receiving therefrom a plurality of PRENET encoder vectors (not shown)). In CFBH layer 72, pre-preprocessing of the plurality of PRENET encoder vectors may occur—e.g., generally helping the network learn a kind of context at the phoneme level. The CFBH layer 72 may include determining maxpooling and convolutions. Maxpooling may be a sample-based (e.g., samples of mel-spectrogram vectors) discretization process where a given input (typically an image) is downsampled so that it 'picks' the maximum of samples in patches while striding through the input. Maxpooling helps reduce the number of input parameters thereby easing the training process, reducing overfitting, and improving translational and rotational invariance. Convolutions may include identifying relationships between uttered words of varying lengths and collating them together—e.g., agglomerating input characters to a more meaningful feature representation taking into account the context at the word level. The determined convolutions then may be sent to a stack of highway layers within the CFBH layer 72. Highway layers are a development of the residual networks idea, wherein an amount of residual signal is modulated in a previously-learned way. The parameters learned by the highway layer are used to gate the amount of residual signal that is allowed through. In general, training is improved when residuality is added to stacks of deep neural networks. In the absence of such mechanisms, it becomes difficult for signals to pass through very deep network stacks. Ultimately, the CFBH layer 72 may output a sequence (e.g., a plurality of preprocessed encoder vectors 80) to the first RNN 74. According to one example, the plurality of preprocessed encoder vectors 80 may have a dimensionality of 80×T; however, this is merely an example.

The first RNN 74 may be a recurrent neural network which operates using a bidirectional pass. According to one non-limiting example, the first RNN 74 is a gated recurrent unit (e.g., GRU (labeled GRU0)); however, other examples also exist (e.g., including but not limited to a vanilla RNN or a long short-term memory (LSTM)). According to one example, first RNN 74 comprises a first internal network (not shown) and a second internal network (not shown). According to bidirectional pass operation, an input sequence is fed in normal time order for the first internal network (e.g., illustrated as left to right arrow; e.g., GRU forward), and in reverse time order for the second internal network (e.g., illustrated as right to left arrow; e.g., GRU backward). The output sequences of the first and second internal networks each may have a dimensionality of 300×T; again, this is merely an exemplary dimensionality, and other dimensionalities may be yielded. According to one example, before providing the output sequences as an input to second RNN 76, these output sequences may be concatenated (e.g., resulting in a single sequence (600×T)) and that concatenated sequence 82 may be reshaped by doubling the stack height and halving the length thereof $$\left(\text{e.g., } 1200x\frac{T}{2}\right).$$

Once reshaped (e.g., by processor(s) 30), a resulting first set of encoder vectors 84 may be provided as input to the second RNN 76.

According to at least one example, second RNN 76 (labeled GRU1) may execute instructions identical to those executed by first RNN 74. For example, upon receiving input sequence 84, the second RNN 76 may perform similar operations yielding an output sequence of a first internal network $$\left(\text{e.g., } 300x\frac{T}{2}\right)$$

and an output sequence of a second internal network $$\left(\text{e.g., } 300x\frac{T}{2}\right)$$

and a concatenation sequence 86

$$\left(\text{e.g., } 600x\frac{T}{2}\right).$$

Before providing the output sequences as an input to third RNN 78, the sequence 86 may be similarly reshaped by processor(s) 30 (e.g., yielding a second set of encoder vectors 88 having an example dimensionality of $$1200x\frac{T}{4}).$$

According to at least one example, third RNN 78 may be identical to first or second RNNs 74, 76. For example, upon receiving input sequence 88, the third RNN 78 may perform similar operations yielding an output sequence of a first internal network $$\left(\text{e.g., } 300x\frac{T}{4}\right)$$

and an output of a second internal network $$\left(\text{e.g., } 300x\frac{T}{4}\right)$$

and a concatenation sequence 90

$$\left(\text{e.g., } 600x\frac{T}{4}\right)$$

—sequence 90 also may be referred to herein as a third set of encoder vectors or a set of hidden encoder vectors. As explained more below, at least one of the encoder vectors of sequence 90 may be sent to an attention block 100.

Turning now to FIGS. 3-4, an example of the decoder 64 will be described. Decoder 64 may comprise a decoder preprocessing neural network (PRENET) 110, an attention recurrent neural network (RNN) 112, and a residual decoder stack 114. Each will be discussed in turn.

Decoder PRENET 110 (e.g., a decoder preprocessing neural network) may be similar to encoder PRENET 70, except that: decoder PRENET 110 forms part of the decoder 64; decoder PRENET 110 incrementally receives as decoder output vectors from set 66 (e.g., which are output from residual decoder stack 114, as discussed below); and decoder PRENET 110 provides as output at least one preprocessed decoder vector 120. Other aspects and functions of decoder PRENET 110 will be appreciated by skilled artisans.

As discussed more below, an attention context vector 130 (from attention block 100) may be concatenated (e.g., by processor(s) 30) with the at least one preprocessed decoder vector 120 to yield an input vector 132 that forms part of a first set of decoder vectors 134—e.g., which may be the input sequence to attention RNN 112.

Attention RNN 112 is a neural network that permits the decoder 64, in part, to focus on (e.g., give 'attention to') certain parts of the input sequence (e.g., 134) when predicting a certain part of an output sequence 136 thereof, enabling easier learning and of higher quality. Output sequence 136 is also referred to herein as a second set of decoder vectors (e.g., or a set of hidden decoder vectors). Other aspects and functions of attention RNN 112 in decoder 64 will be appreciated by skilled artisans.

Residual decoder stack 114 is a neural network stack that comprises residual properties—e.g., namely, residual learning or determining error and using the error to improve decoding accuracy. Accordingly, the residual decoder stack 114 receives, as input, the second set of decoder vectors 136 and provides as output the set of decoder output vectors 66 (e.g., also referred to as an output sequence). As illustrated, at least one decoder output vector 140 of the set of decoder output vectors 66 may be provided as feedback into the decoder PRENET 110. Other aspects and functions of residual decoder stack 114 in decoder 64 will be appreciated by skilled artisans.

Returning again to FIG. 3, the attention block 100 is described. Attention block 100 may operate similarly to attention RNN 112; however, attention block 100 receives as input at least one hidden encoder vector from the sequence 90 (output of the third RNN 78) and at least one hidden decoder vector 150 of the set of hidden decoder vectors 136 (e.g., the output of the attention RNN 112 of decoder 64). Accordingly, attention block 100 may output the attention context vector 130 (FIGS. 3-4), described above. And as shown in FIG. 4, vector 130 may be provided as input to decoder 64—e.g., being concatenated with the at least one preprocessed decoder vectors 120. Other aspects and functions of attention block 100 will be appreciated by skilled artisans.

Figure 5:
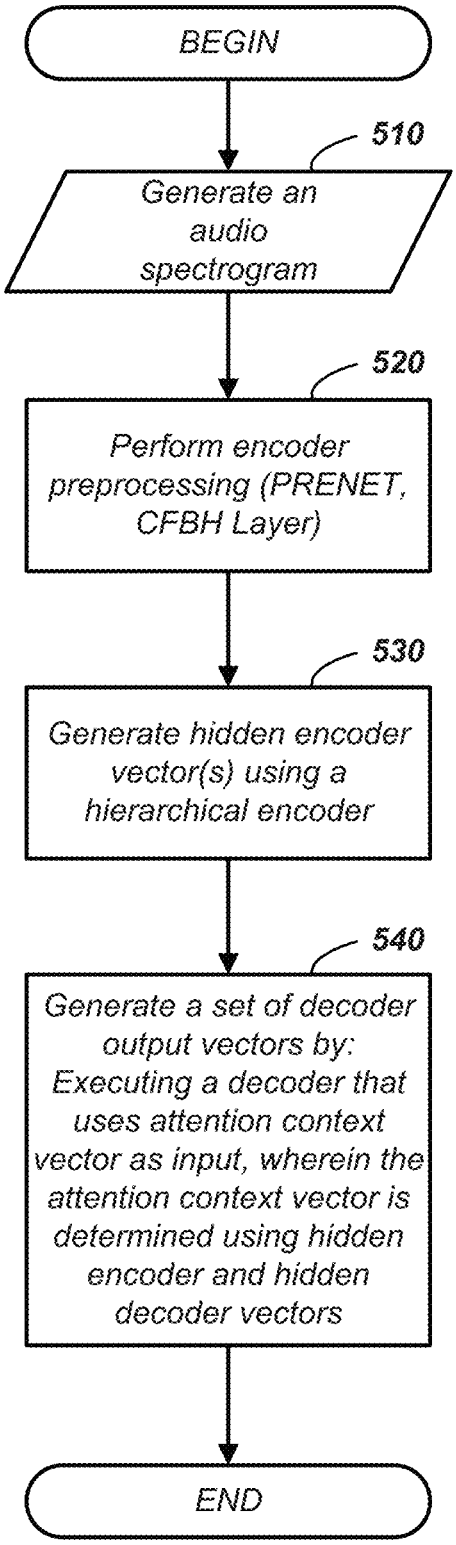
FIG. 5 is a flow diagram illustrating a speech conversion process which may be carried out using the encoder and decoder shown in FIGS. 3-4.

Turning now to FIG. 5, a speech conversion process 500 is disclosed. The process 500 may be carried out by processor(s) 30 of computer 12 or any other suitable computing device. The process begins with block 510.

In block 510, computer 12 generates an input (an audio spectrogram) for the encoder 60 and decoder 64. As discussed above, this may comprise receiving an audio signal comprising speech via audio-input system 14 and processing this signal to convert the speech into a mel-spectrogram. It should be appreciated that, according to system 10, computer 12 need not convert relatively large segments of speech into a single mel-spectrogram—but rather, it may accept and process relatively smaller segments of speech thereby minimizing losses associated with temporality (e.g., the context of the speech may be retained—including speech pertaining to timeliness and/or present locality). For example, conversion of larger segments of speech may result in less accurate conversions and/or data loss. However, as system 10 is a sequence-to-sequence (seq2seq) system, smaller segments of speech may be processed thereby minimizing such losses.

In block 520 which follows, computer 12 may perform any suitable preprocessing of the spectrogram. For example, according to an implementation using encoder 60, this may comprise processing the spectrogram 62 using the encoder PRENET 70 and CFBH layer 72 and providing the plurality of preprocessed encoder vectors 80 to the first RNN 74.

In block 530 which follows, computer 12 (using encoder 60) may process the sequence 80 using the previously-described hierarchical encoder 60. More particularly, as shown in FIG. 3, the first RNN 74 (GRU0) may generate concatenated sequence 82 (having an illustrative dimensionality 600×T). Thereafter, computer 12 may reshape the sequence 82 yielding the first set of encoder vectors 84 (having an illustrative dimensionality $$1200x\frac{T}{2}).$$

Continuing within block 530, the second RNN 76 (GRU1) may receive as input the first set of encoder vectors 84. And the second RNN 76 may generate concatenated sequence 86 (having an illustrative dimensionality $$600x\frac{T}{2}).$$

Thereafter, computer 12 may reshape the sequence 86 yielding the second set of encoder vectors 88 (having an illustrative dimensionality $$1200x\frac{T}{4}).$$

Continuing within block 530, the third RNN 78 (GRU2) may receive as input the second set of encoder vectors 88. And the third RNN 78 may generate concatenated sequence 90 (e.g., the third set of encoder vectors, a.k.a., a set of hidden encoder vectors) (having an illustrative dimensionality $$600x\frac{T}{4}).$$

Figure 6:
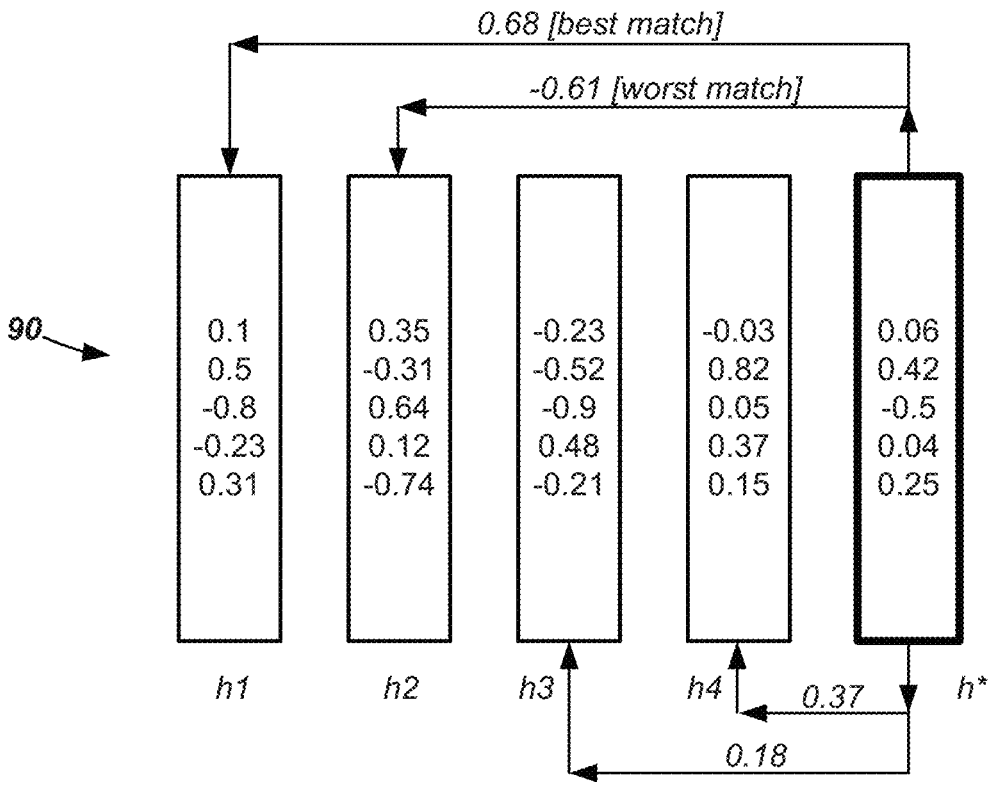
FIG. 6 is a schematic view illustrating a comparison of hidden encoder vectors (e.g., of the encoder shown in FIG. 3).

Computer 12 may provide at least one of these hidden encoder vectors 90 as input to the attention block 100. For example, consider the diagram shown in FIG. 6 illustrating four example hidden encoder vector h1 (represented by a vertical vector 0.1, 0.5, −0.8, −0.23, and 0.31), vector h2 (represented by a vertical vector 0.35, −0.31, 0.64, 0.12, and −0.74), vector h3 (represented by a vertical vector −0.23, −0.52, −0.9, 0.48, and −0.21), and vector h4 (represented by a vertical vector −0.03, 0.82, −0.05, 0.37, and 0.15). It should be appreciated that the quantity of vectors shown in FIG. 6 is merely an example (and may comport with an actual quantity of vectors of sequence 66). Further, FIG. 6 illustrates a previous best match vector h* (e.g., from a previous iteration of the encoder 60). According to an example of block 530, computer 12 may determine which of vectors 66 to send to the attention block 100. According to one example, computer 12 may determine a similarity score between vector h* and vectors h1, h2, h3, and h4 to determine a best match. For example, according to an example, a higher score equates to a better match. Thus, when computer 12 determines scores of −0.61, 0.18, 0.37, and 0.68 for h2, h3, h4, and h1, respectively, with respect to values of vector h*, computer 12 may determine that vector h1 is the best match and provide vector h1 to the attention block 100 (e.g., to determine an updated attention context vector).

Below, operation of the attention block 100 and decoder 64 will be described (block 540); however, it should be appreciated that the operation of encoder 60 may continue (concurrently).

Returning to FIG. 5, in block 540, computer 12 may generate set of decoder output vectors 66 by: executing decoder 64 that uses attention context vector 130 as input, wherein the attention context vector 130 is determined at attention block 100 using a best match hidden encoder vector h1 of sequence 90 (e.g., from encoder 60) and previously-generated hidden decoder vector 150 (e.g., labeled $S_{i-3}$ in FIG. 3) of set 136 of decoder 64.

Decoder 64 may concatenate the attention context vector 130 with vector 120 (from decoder PRENET 110) and this may form part of the input to attention RRN 112. The second set of decoder vectors 136 may be provided to the residual decoder stack 114, and the stack 114 may yield the set of decoder output vectors 66. As additional attention context vectors (130) are provided, at least one vector of the set of decoder output vectors 66 may be fed back into the decoder PRENET 110, as shown in FIG. 4.

According to one example, the set of decoder output vectors 66 are provided to post-processing unit 50 to be converted back to an audio signal (e.g., using a wavenet or the like) which is emitted by loudspeaker 52. This is merely an example and is not executed in all implementations.

Again, blocks 510-540 may be operated continuously as speech is received. However, at any suitable time following execution of block 540, process 500 may end.

It should be appreciated that, as part of encoder 60, additional RNNs may be used in some examples. For instance, in the present example, three RNNs were used, wherein the output sequence of one RNN was an input sequence to another. However, in other examples, more or fewer RNNs may be used.

Thus, there has been described a speech conversion system comprising an encoder and a decoder. The speech conversion system may be employed in a vehicle; however, this is not required. The encoder comprises multiple hierarchical neural networks, wherein a subsequent neural network receives, as input, an output sequence of the previous neural network. Further, the output sequence of the previous neural network may be concatenated and reshaped.

In general, the computing systems and/or devices described may employ any of a number of computer operating systems, including, but by no means limited to, versions and/or varieties of the Ford SYNC® application, AppLink/Smart Device Link middleware, the Microsoft® Automotive operating system, the Microsoft Windows® operating system, the Unix operating system (e.g., the Solaris® operating system distributed by Oracle Corporation of Redwood Shores, Calif.), the AIX UNIX operating system distributed by International Business Machines of Armonk, N.Y., the Linux operating system, the Mac OSX and iOS operating systems distributed by Apple Inc. of Cupertino, Calif., the BlackBerry OS distributed by Blackberry, Ltd. of Waterloo, Canada, and the Android operating system developed by Google, Inc. and the Open Handset Alliance, or the QNX® CAR Platform for Infotainment offered by QNX Software Systems. Examples of computing devices include, without limitation, an on-board vehicle computer, a computer workstation, a server, a desktop, notebook, laptop, or handheld computer, or some other computing system and/or device.

Computing devices generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Python™, Java™, C, C++, Visual Basic, Java Script, Perl, etc. Some of these applications may be compiled and executed on a virtual machine, such as the Java Virtual Machine, the Dalvik virtual machine, or the like. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random-access memory (DRAM), which typically constitutes a main memory. Such instructions may be transmitted by one or more transmission media, including coaxial cables, copper wire and fiber optics, including the wires that comprise a system bus coupled to a processor of a computer. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store is generally included within a computing device employing a computer operating system such as one of those mentioned above and are accessed via a network in any one or more of a variety of manners. A file system may be accessible from a computer operating system and may include files stored in various formats. An RDBMS generally employs the Structured Query Language (SQL) in addition to a language for creating, storing, editing, and executing stored procedures, such as the PL/SQL language mentioned above.

In some examples, system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein.

The processor is implemented via circuits, chips, or other electronic component and may include one or more microcontrollers, one or more field programmable gate arrays (FPGAs), one or more application specific circuits ASICs), one or more digital signal processors (DSPs), one or more customer integrated circuits, one or more graphic processing units (GPUs), one or more tensor processing units (TPUs), etc. The processor may be programmed to process the sensor data. Processing the data may include processing the video feed or other data stream captured by the sensors to determine the roadway lane of the host vehicle and the presence of any target vehicles. As described below, the processor instructs vehicle components to actuate in accordance with the sensor data. The processor may be incorporated into a controller, e.g., an autonomous mode controller.

The memory (or data storage device) is implemented via circuits, chips or other electronic components and can include one or more of read only memory (ROM), random access memory (RAM), flash memory, electrically programmable memory (EPROM), electrically programmable and erasable memory (EEPROM), embedded MultiMediaCard (eMMC), a hard drive, or any volatile or non-volatile media etc. The memory may store data collected from sensors.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

The invention claimed is:

1. A speech conversion system, comprising:

a processor; and memory storing instructions executable by the processor, the instructions comprising, to:

determine a first set of encoder vectors corresponding to human speech by inputting a spectrogram corresponding to human speech to a first encoder preprocessing neural network;

using a first recurrent neural network (RNN) (GRU0) and the preprocessed encoder vectors as input to the first RNN, determine a first concatenated sequence;

using a second RNN (GRU1) and the first set of encoder vectors derived from a spectrogram corresponding to human speech as input to the second RNN, determine a second concatenated sequence;

determine a second set of encoder vectors by doubling a stack height and halving a length of the second concatenated sequence;

using the second set of encoder vectors, determine a third set of encoder vectors; and decode the third set of encoder vectors using an attention block.

2. The system of claim 1, wherein the instructions further comprise to, prior to determining the second concatenated sequence, determine the first set of encoder vectors by doubling a stack height and halving a length of the first concatenated sequence.

3. The system of claim 2, wherein the first and second RNNs are gated recurrent unit (GRUs) and each are bidirectional pass.

4. The system of claim 1, wherein the processor further uses a third RNN, wherein the third RNN receives, as input, the second set of encoder vectors and provides, as output, the third set of encoder vectors.

5. The system of claim 4, wherein the third RNN is a gated recurrent unit (GRU) and is bidirectional pass.

6. The system of claim 1, wherein the spectrogram is a mel-spectrogram.

7. The system of claim 1, wherein the spectrogram comprises a plurality of concatenated vectors, wherein the spectrogram is a visual representation of a speech utterance.

8. The system of claim 1, wherein the instructions further comprise to, prior to determining the second set of encoded vectors:

based on the input and using an encoder preprocessing neural network (PRENET) and a convolutional filterbanks and highways (CFBH) layer, determine a plurality of preprocessed encoder vectors; and using a first RNN (GRU0) and the plurality of preprocessed encoder vectors as input to the first RNN, determine the first set of encoder vectors.

9. The system of claim 1, wherein the instructions further comprise to: at the attention block, iteratively generate an attention context vector; and provide the attention context vector.

10. The system of claim 9, wherein the instructions further comprise to: determine a best match vector from among the third set of encoder vectors by comparing the third set of encoder vectors to a previous-best match vector; and provide the attention block with the best match vector in order to determine an updated attention context vector.

11. The system of claim 1, wherein the instructions further comprise to:

at the attention block: receive as input one of the third set of encoded vectors;

at the attention block: receive as input at least one of a set of decoder hidden vectors;

at the attention block: determine an attention context vector; and provide the attention context vector.

12. The system of claim 1, wherein the third set of encoded vectors are a set of hidden encoder vectors.

13. The system of claim 1, wherein the instruction to decode further comprises to:

determine a set of hidden decoder vectors by receiving as input, at an attention recurrent neural network (RNN), a first set of decoder vectors, wherein at least one of the first set of decoder vectors comprises a concatenation of an attention context vector and at least one of a plurality of preprocessed decoder vectors;

using a residual decoder stack and the set of hidden decoder vectors, determine a set of decoder output vectors;

feedback at least one of the set of decoder output vectors as input to a decoder preprocessing neural network (PRENET); and use the decoder PRENET to determine and update the plurality of preprocessed decoder vectors.

14. The system of claim 13, wherein the instruction to decode further comprises to: in response to receiving an updated attention context vector, provide an updated at least one of the set of decoder output vectors to the decoder PRENET.

15. A method of speech conversion, comprising:

determining a first set of encoder vectors corresponding to human speech by inputting a spectrogram corresponding to human speech to a first encoder preprocessing neural network;

using a first recurrent neural network (RNN) (GRU0) and the preprocessed encoder vectors as input to the first RNN, determine a first concatenated sequence;

using a second RNN (GRU1) and the first set of encoder vectors derived from a spectrogram corresponding to human speech as input to the second RNN, determining a second concatenated sequence;

determining a second set of encoder vectors by doubling a stack height and halving a length of the second concatenated sequence;

using the second set of encoder vectors, determining a third set of encoder vectors; and decoding the third set of encoder vectors using an attention block.

16. The method of claim 15, further comprising, prior to determining the second concatenated sequence, determining the first set of encoder vectors by doubling a stack height and halving a length of the first concatenated sequence.

17. The method of claim 15, further comprising, prior to determining the second set of encoded vectors:

based on the input and using an encoder preprocessing neural network (PRENET) and a convolutional filterbanks and highways (CFBH) layer, determining a plurality of preprocessed encoder vectors; and using a first RNN (GRU0) and the plurality of preprocessed encoder vectors as input to the first RNN, determining the first set of encoder vectors.

18. The method of claim 15, further comprising, at the attention block, iteratively generating an attention context vector; and providing the attention context vector.

19. The method of claim 18, further comprising, determining a best match vector from among the third set of encoder vectors by comparing the third set of encoder vectors to a previous-best match vector; and providing the attention block with the best match vector in order to determine an updated attention context vector.

20. The method of claim 15, further comprising:

at the attention block: receiving as input one of the third set of encoded vectors;

at the attention block: receiving as input at least one of a set of decoder hidden vectors;

at the attention block: determining an attention context vector; and providing the attention context vector.

* * * * *